United States Patent [19]

Magill et al.

[11] 4,256,143

[45] Mar. 17, 1981

[54] SHUT-OFF DAMPER

[75] Inventors: Robert J. Magill, Whitstable; Sydney J. Field, Ashford, both of England

[73] Assignee: Actionair Equipment Limited, Whitstable, England

[21] Appl. No.: 94,186

[22] Filed: Nov. 13, 1979

[30] Foreign Application Priority Data

Nov. 22, 1978 [GB] United Kingdom ..... 45677/78

[51] Int. Cl.[3] ..... F16K 13/00

[52] U.S. Cl. ..... 137/601; 49/92; 251/306

[58] Field of Search ..... 49/91, 92, 475, 480, 49/485, 489, 491, 496, 499; 98/110, 121 A; 137/601; 251/306, 307

[56] References Cited

U.S. PATENT DOCUMENTS

| | | | |
|---|---|---|---|
| 1,872,599 | 8/1932 | LeGrand | 137/601 X |
| 2,683,907 | 7/1954 | Lovasik | 49/498 |
| 2,905,985 | 9/1959 | Garrett | 49/499 |
| 3,084,715 | 4/1963 | Scharres | 137/601 |
| 3,180,246 | 4/1965 | Johnson | 98/110 X |
| 3,357,137 | 12/1967 | Lombardi | 49/485 X |
| 3,372,514 | 3/1968 | Adams | 49/91 |
| 3,771,559 | 11/1973 | Alley | 137/601 |
| 3,783,768 | 1/1974 | Caming | 98/110 |
| 3,885,347 | 5/1975 | Adachi | 137/601 X |
| 4,192,098 | 3/1980 | Brzezinski | 137/601 X |

FOREIGN PATENT DOCUMENTS

| | | | |
|---|---|---|---|
| 979713 | 12/1975 | Canada | 98/110 |
| 1059494 | 4/1977 | Canada | 251/306 |
| 2622078 | 6/1977 | Fed. Rep. of Germany | 98/121 A |

*Primary Examiner*—Robert G. Nilson

*Attorney, Agent, or Firm*—Berman, Aisenberg & Platt

[57] ABSTRACT

A shut-off damper comprising a line of blades which are supported in a surrounding frame for rotary motion about substantially parallel axes to open or close an opening in the frame, and springy sealing strips each provided with a lining or cover of synthetic rubber or other resilient material so that the end portions of the blades make sealing contact with the said linings or covers to reduce or prevent the leakage of fluid past the blades when they are in their fully-closed positions.

13 Claims, 12 Drawing Figures

SHUT-OFF DAMPER

This invention relates to a shut-off damper comprising a line of blades which are supported in a surrounding frame for rotary motion about substantially parallel axes to open or close an opening in the frame.

In the Complete Specification filed on May 25 1978 on our co-pending British Patent Application No. 26388/77, we have described a damper of the above construction in which the end portions of the blades or parts associated therewith are arranged to make sealing contact with respective springy sealing strips so as to reduce the leakage of smoke through the damper in the event of fire. The sealing strips specifically described in that specification are made of springy steel and are of arched section, the strips being arranged to lie between flanges provided on blade bearing components and respective opposing surfaces of the frame. In addition, the strips have holes formed in them to allow for the passage therethrough of shafts supporting the ends of the blades.

Further, in the Complete Specification filed on Feb. 9, 1978 in respect to our cognate British Patent Applications Nos. 6184/77 of Feb. 15, 1977 and 10895/77 of April 29, 1977, we have described a shut-off damper wherein the blades are of generally streamlined shape with the trailing edges of the blades comprising fluid sealing means extending along those edges so that a seal is formed between adjacent blades when the blades are in their closed positions. The same construction is shown in U.S. Pat. application Ser. No. 877,185 filed on Feb. 13, 1978 in the name of R. J. Magill et al, now abandoned, and in Canadian Patent Application Ser. No. 297,107 filed on Feb. 14, 1978, which Applications correspond to the said British Complete Specification. The fact that the blades comprise fluid sealing means along their trailing edges means that leakage of air at the longitudinal edges of the blades can be reduced to a negligible amount when the blades are in their fully-closed positions.

The present invention constitutes a development of the constructions described in the above-mentioned earlier Applications of ours in that we have now devised improved blade sealing means.

Accordingly, the present invention is directed to a shutoff damper comprising a line of blades which are supported in a surrounding frame for rotary motion about substantially parallel axes to open or close an opening in the frame, and at least two springy sealing strips arranged at the ends of the blades, in which the springy sealing strips are each provided with a lining or cover of synthetic rubber or other resilient material so that the end portions of the blades make sealing contact with the said linings or covers to reduce or prevent the leakage of fluid past the blades when they are in their fully-closed positions.

Preferably, the springy sealing strips are in the form of stainless steel spring-tempered flexible gaskets which are encompassed, partially or totally, within extruded, speciallycontoured, highly resilient, flame-retardant synthetic rubber linings or covers to provide "double-compression" side seals which reduce operational torque during movement of the blades and greatly reduce air leakage when the blades are in the fullyclosed positions.

In a preferred form of the invention, the blades are of generally streamlined shape, their trailing edges having fluid sealing means in the form of extrusions of synthetic rubber or other resilient material, the extrusions being nipped between bent-over trailing edge portions of the blades.

Preferably, the blades are stainless steel, low-profile aspect ratio aerofoil blades of spot-welded double-skin construction which interlock a hollow, extruded, highly-resilient, flame-retardant synthetic rubbery sealing member within twin trailing edges.

Two examples of shut-off dampers in accordance with the invention are illustrated in the accompanying drawings, in which:-

Figure 1:
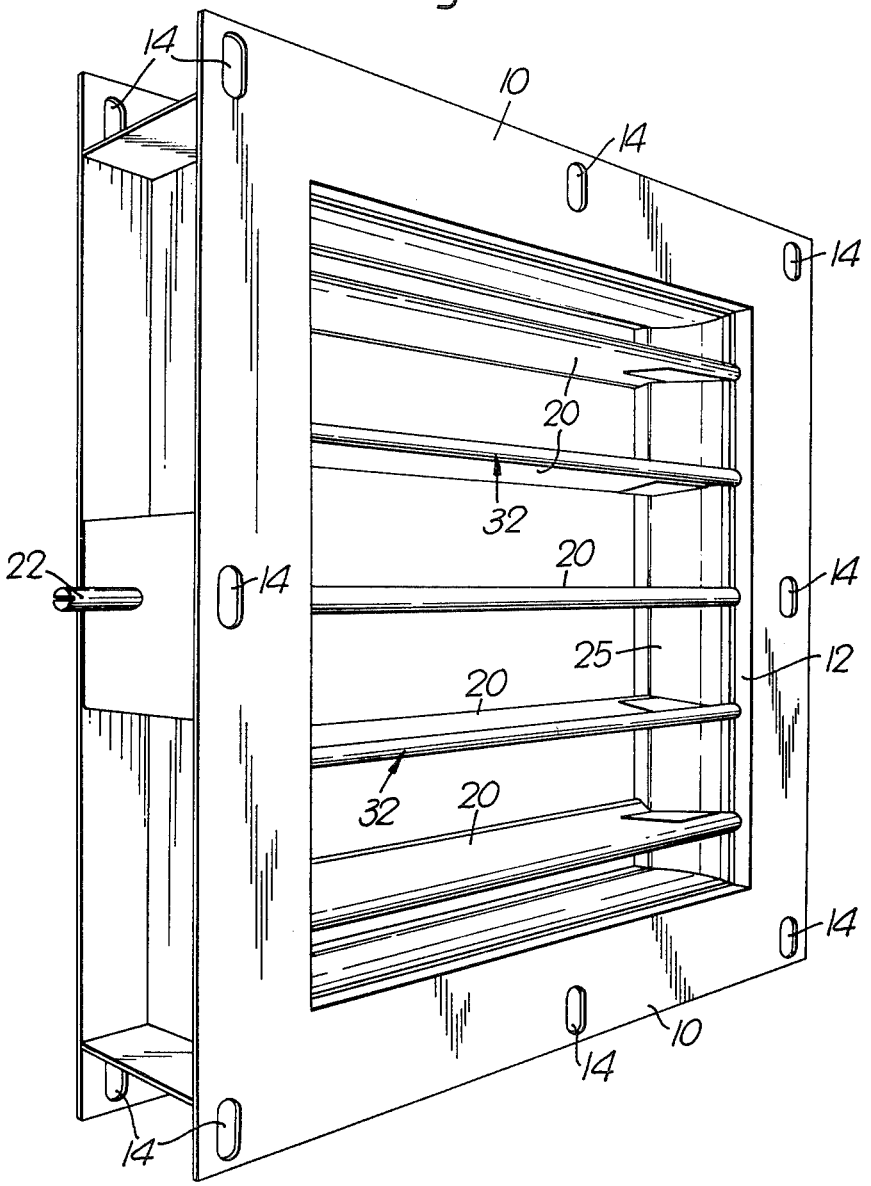
FIG. 1 is a perspective view of one form of shut-off damper.

The shut-off damper shown in FIG. 1 comprises a rollformed galvanised sheet steel outer frame 10 of girder section and a sheet steel inner frame 12. The outer frame 10 has continuously-welded corners and has elongated holes 14 punched in it to permit the damper to be bolted to the flanges of an air duct and to be adjusted for height on those flanges. The attachment by welding, bolting, rivetting or other means of the inner and outer frames together produces a double-skin air-tight casing of high rigidity and substantial strength.

Figure 9:
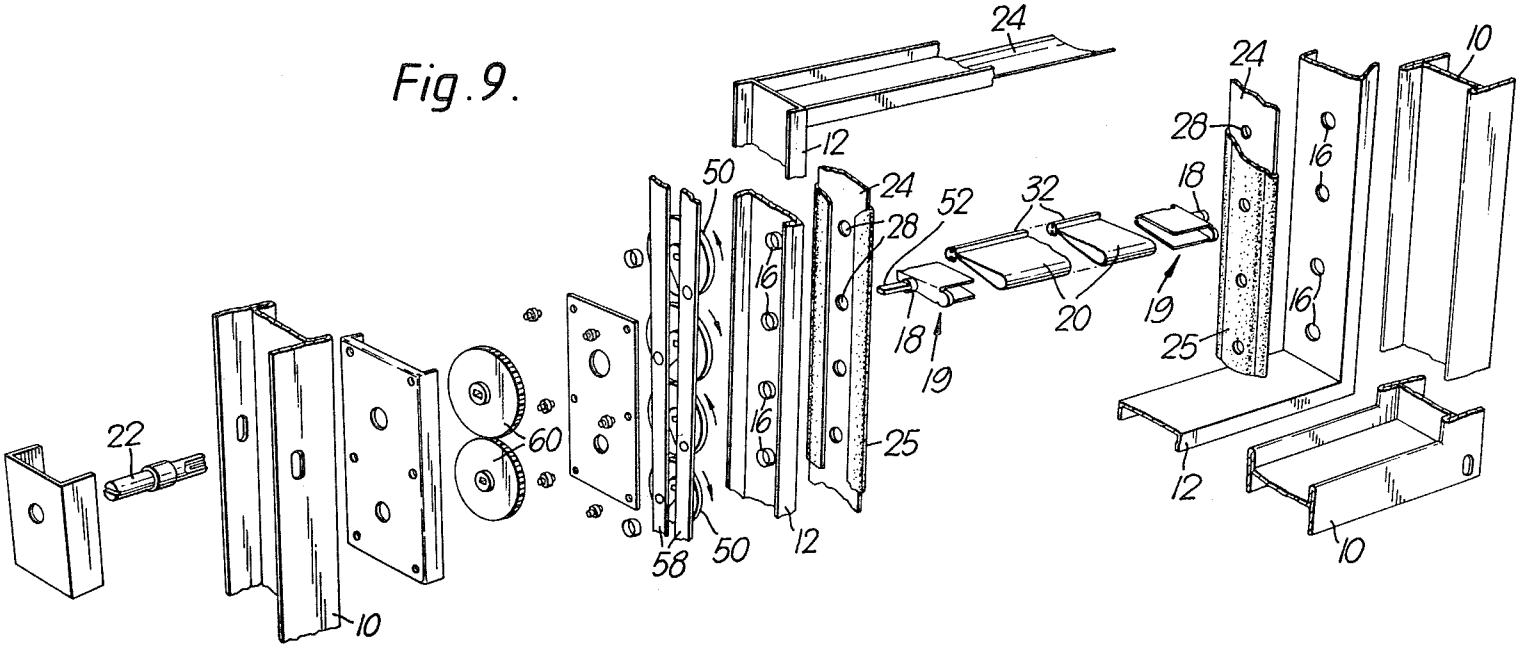
FIG. 9 is an exploded perspective view of parts of the damper shown in FIG. 1.

The inner frame 12 has a series of holes 16 punched in its two vertical sides (see FIG. 9), which holes serve to support the shafts 18 of blade bearing components 19 which fit into and onto the open ends of blades 20. The latter are thus mounted for rotation in the frame about substantially parallel axes. The blades 20 are low-profile aspect ratio aerofoil stainless steel blades to provide low resistance to air or other gaseous fluid flowing through the damper, especially when the blades are in their fully-open positions (i.e. the positions of the blades shown in FIG. 1 of the drawings). The aerofoil section of the blades also reduces turbulence and noise and provides excellent protection against corrosion resulting from the presence of corrosive particles in the air stream. Another advantage is that the narrow blade width readily permits the withdrawal of the complete damper from a duct, regardless of the positions of the blades within the damper casing, without materially disturbing the flow of air through the duct frame as a whole.

Rotation of the blades 20 about their respective axes can be effected either manually or through poweroperated means. Thus, a manually-rotated control knob (not shown) can be fitted onto a control shaft 22 (see FIG. 1) which is effective to rotate the blades 20 simultaneously, but with alternate blades turning in opposite senses, when the control knob is rotated to turn the shaft 22. Alternatively, an hydraulic, pneumatic, electric or electromagnetic motor (not shown) may be connected to the shaft 22 so as to turn it. Remote control of the blades then becomes possible.

Figure 2:
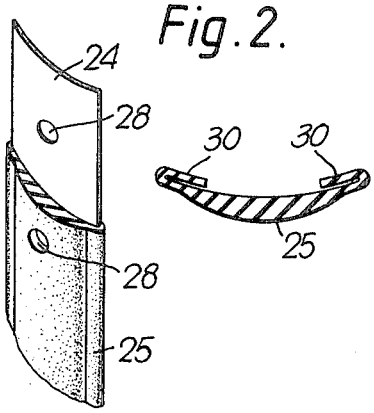
FIG. 2 is a part-sectional perspective view of one of the side sealing strips provided in the damper.
Figure 5:
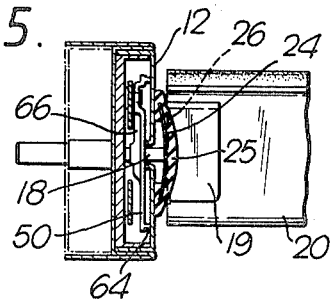
FIG. 5 is a section through a blade end support and the components immediately adjacent it.

As already indicated, the illustrated damper is a shut-off damper. Accordingly, to seal the ends of all the blades, a pair of springy metal sealing strips 24, one of which is shown in FIG. 2, each have a liner or covering 25 in the form of a synthetic rubber extrusion and are arranged along the upright inner side surfaces of the inner frame 12. Each sealing strip 24 is here made of springy stainless steel and is of arched section. As shown in FIG. 5, the two strips 24 and their respective rubber liners 25 at the sides of the damper lie between shoulders 26 on the blade bearing components 19 and the opposing surfaces of the inner frame 12, the strips 24 and their liners 25 having matching holes 28 formed in them to allow for the passage therethrough of the shafts 18. The arched form of the strips 24 and their inherent springiness combines with the yielding properties of the synthetic rubber liners 25 to produce a "double-compression" seal for the ends of the blades at the sides of the damper frame. In this way, the leakage of air past the ends of the blades when they are in their fully-closed positions is greatly reduced. As will be seen from FIG. 2, the liners 25 each have turned-over side flanges 30 which embrace the longitudinal edges of the respective strips 24.

Although the liners 25 will invariably be synthetic rubber extrusions, it is to be understood that they could be produced in other forms and in other materials. For example, the liners could be formed by coating the metal strips with a thermoplastic material in molten or other liquid form, a rubbery coating thus being formed on the strips once the thermoplastic material has set. Alternatively, the liners 25 could be in the form of a synthetic plastics foam material which is bonded to the metal strips.

Figure 3:
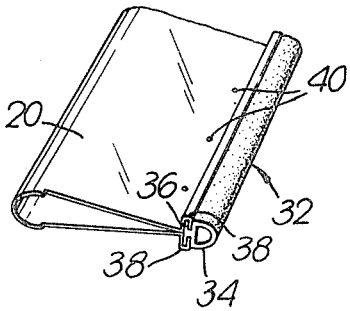
FIG. 3 is an enlarged perspective view in section of one of the blades and its trailing edge sealing means.
Figure 4:
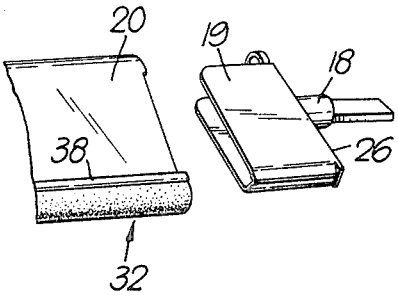
FIG. 4 is an enlarged perspective view illustrating an end portion of one of the blades and the means for supporting that end.

In order to prevent leakage of fluid at the longitudinal edges of the blades when the latter are in their fully-closed positions, each blade 20 has fluid sealing means extending along its trailing edge so that a good seal is formed between adjacent blades. As shown in FIGS. 3 and 4, the sealing means take the form of a synthetic rubber extrusion 32 having a hollow D-section portion 34 as well as a T-section portion 36 which is gripped between two opposing U-shaped flanges 38 at the trailing edge of each blade 20. After the blade has been bent into blade-shape from a flat rectangular sheet of stainless steel, it is sealed by being spot-welded, brazed, rivetted or otherwise connected at spaced-apart points 40 adjacent its trailing edge. At the same time, its trailing edge portions are bent double to form the opposed U-section flanges 38. The T-section portion 36 of the extrusion 32 can then be slid into the U-section flanges 38, which are then pressed so that the synthetic rubber is nipped between the bent-over portions of the blades. Preferably the extrusions 32 are made of the same synthetic rubber as the liners 25.

Figure 6:
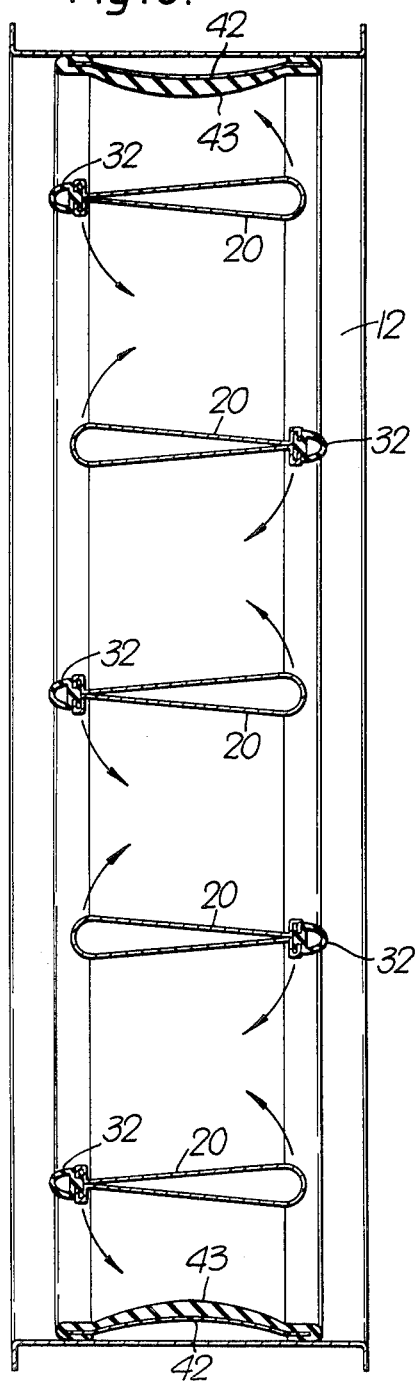
FIGS. 6 and 7 are diagrammatic sectional views showing the blades in their open and closed positions respectively.
Figure 7:
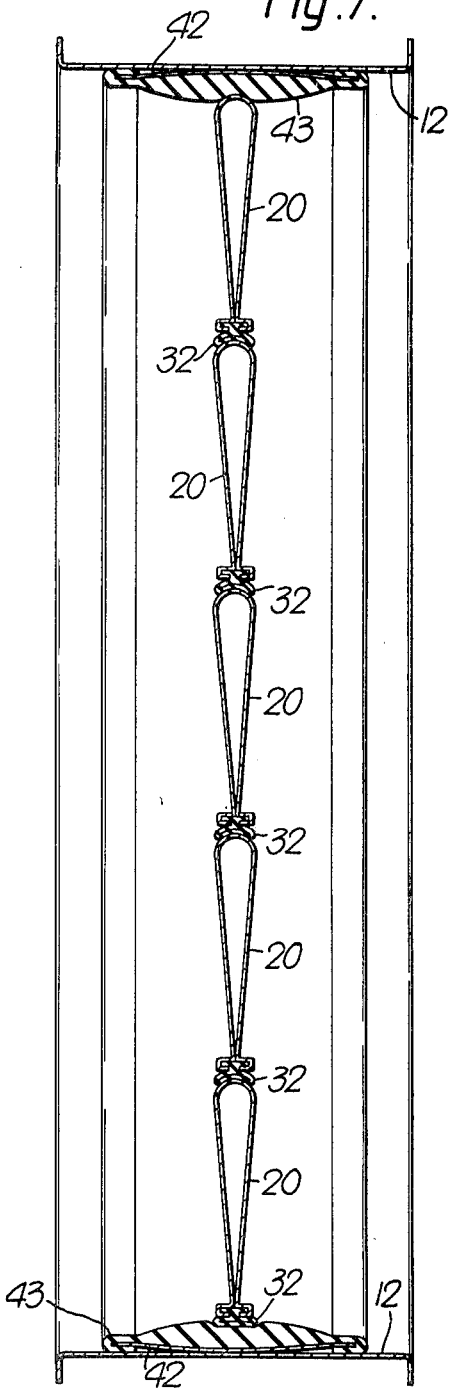

When the blades 20 are moved from their fully-open positions shown in FIG. 6 to their fully closed positions shown in FIG. 7, the D-section portion 34 of each extrusion 32 will be highly compressed by the leading edge of an adjacent blade. By this means, leakage of air at the leading and trailing edges of the blades can be reduced, in practice, to a negligible amount.

To seal the leading edge of the uppermost blade and the trailing edge of the lowermost blade, two arched-section sealing strips 42 of the same springy metal as the strips 24 with liners 43 of the same rubbery material as the liners 25 are positioned along the top inner surface and the bottom inner surface of the inner frame 12 as shown in FIG. 7. However, it may be possible to dispense with the lower strip 42, or the liner 43 thereof, since the extension 32 on the trailing edge of the lowermost blade may suffice to provide a seal between that edge and the bottom inner surface of the inner frame 12, or the bare strip 42 thereon.

Figure 8:
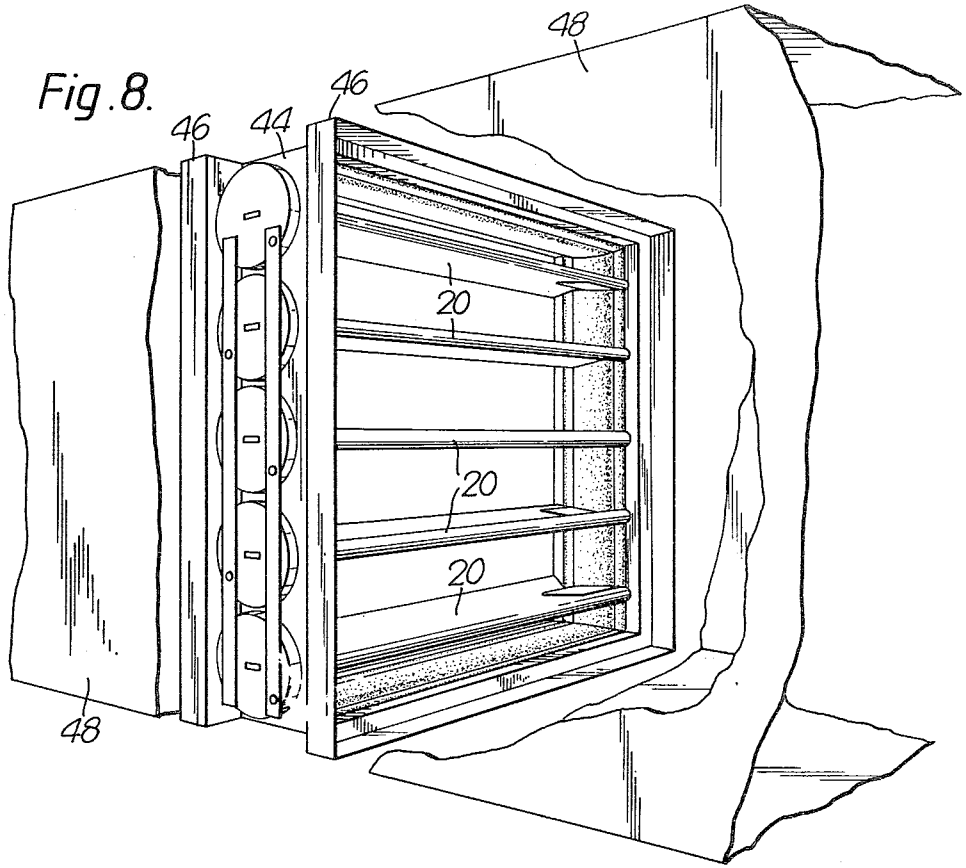
FIG. 8 is a perspective view of another form of shut-off damper having a frame which permits it to be inserted into a duct and to lie wholly within the latter.

The damper illustrated in FIG. 1 is designed to be inserted in a duct by having the flanges of the outer casing 10 bolted to corresponding flanges of two opposing duct portions. In other words, the damper is inserted in a "break" in a duct so that the inner frame 12 is substantially flush with the internal surfaces of the duct. However, in certain countries—particularly the United States of America—it is customary to position dampers entirely within a duct. FIG. 8 illustrates a damper having a frame 44 which permits this to be done. The frame 44 is, in effect, the same as the inner frame 12 in FIG. 1 except that the frame 44 has flanges 46 which lie against the inner surface of a duct 48. The duct itself therefore forms an outer frame for the damper so that the outer frame 10 of FIG. 1 is no longer needed. Apart from this, the damper shown in FIG. 8 is essentially the same as that shown in FIG. 1.

The drive mechanism by means of which the shut-off damper shown in FIGS. 1 to 7 is opened and closed will now be described in greater detail with reference to FIG. 5 and FIGS. 9 to 12.

Rotation of the blades about their respective axes is effected through smooth-rimmed, punched-out metal caps or discs 50, there being a respective cap or disc 50 for each blade 20. As will be seen from FIG. 9, the shaft 18 of each blade bearing component 19 has a keyed end 52. The shafts 18 on one side of the damper have their keyed ends 52 arranged to enter rectangular-section central holes 54 in the caps or discs 50 (see FIG. 12) which are arranged in rim-to-rim engagement and disposed in a line vertically of the damper. The caps or discs 50 rotate in unison due to the fact that each one is pivotally attached by a respective pivot pin 56 to one of two parallel connecting bars or rods 58. Longitudinal displacement of the bars or rods 58 in the same direction will thus cause all the blades 20 to move together about their respective axes. However, as shown by the arrows in FIG. 9, alternate caps or discs 50 will rotate in opposite senses so that adjacent pairs of blades 20 will likewise rotate in opposite senses or directions to open or close the central passage through the damper.

A mechanism to drive the caps 50 and the bars 58, comprises two, but only two, meshing gear wheels 50 which serve to drive a selected one, or at most two, of the caps 50 from the shaft 22 driven by a motor (not shown) or turned by hand.

Figure 10:
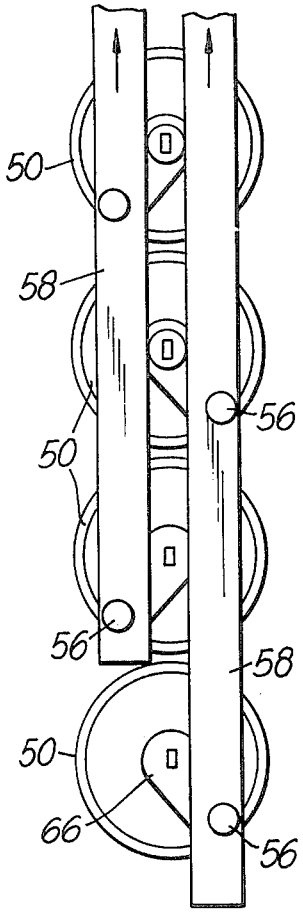
FIGS. 10 and 11 are both front views of caps and drive bars forming parts of the damper shown in FIGS. 1 to 7.
Figure 11:
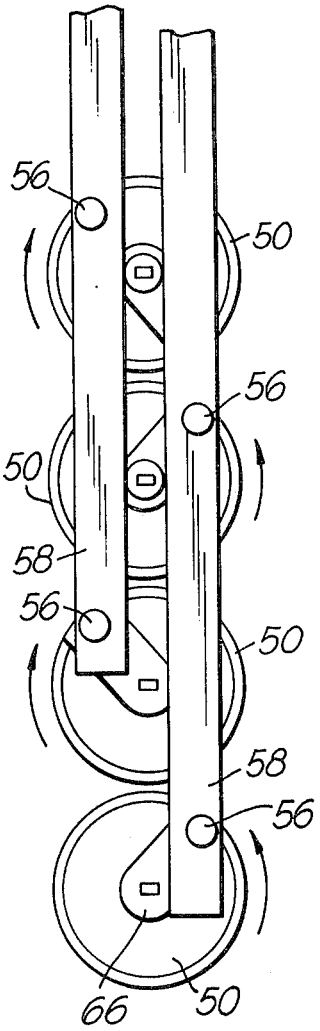
Figure 12:
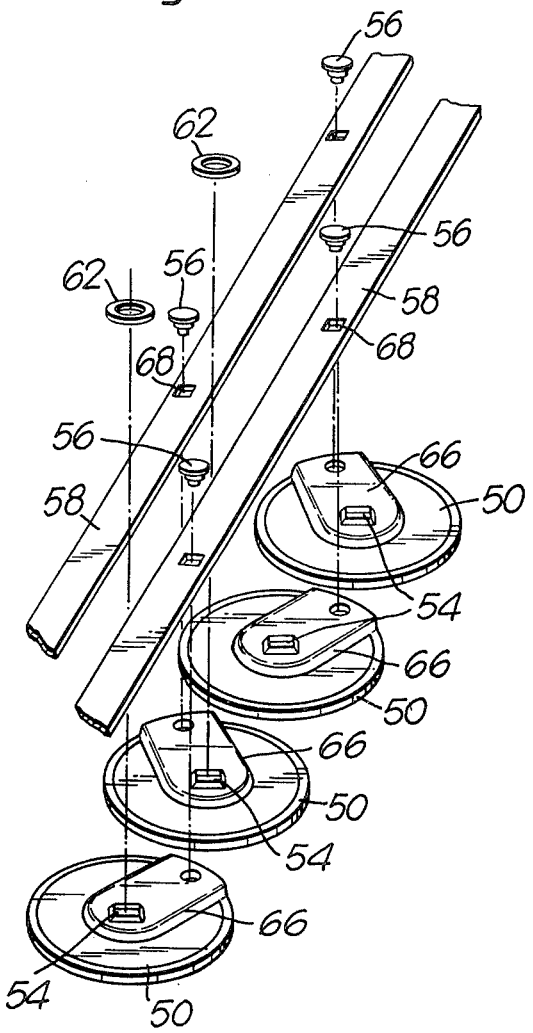
FIG. 12 is an exploded perspective view of caps and drive bars shown in FIGS. 10 and 11.

FIGS. 10 to 12 show the caps 50 and the bars 58 in a little more detail. The angular positions of the caps 50 and the longitudinal positions of the bars 58 shown in FIG. 10 correspond to the fully-open positions of the blades 20, while their positions illustrated in FIG. 11 correspond to the fully closed positions of the blades. FIG. 12 shows how the caps and bars are pivotally connected together, it being noted that circular metal bushes 62 are fitted over selected blade bearing shafts 18 to act as stops in controlling the movement of the bars 58 so that the overall angle of blade rotation, which would otherwise be from 0° to about 115° or more, is precisely from 0° (which is the completely open blade position wherein the blades offer minimum resistance to flow) to 90° which is the fully closed position wherein the blades provide the absolute lowest flow leakage, there being also the choice of any intermediate blade position to suit operating requirements.

The caps or discs 50 are made very simply by being pressed out from sheet metal with their extruded rectangular holes 54 providing accurate blade bearing shaft alignment. As will be seen from FIG. 5, the caps 50 each have a circular peripheral indent or flange 64 to reduce friction and ensure stability throughout the total operating arc. It will also be noted that a raised radial rib 66 is formed in each cap so as to reduce friction between the caps and the bars 58. The production of such caps does not give rise to the same manufacturing tolerance difficulties as precision-made gear wheels.

The drive bars or rods 58 are equally simple to make from sheet metal and have pre-punched square holes 68 for minimum contact area with the round pins 56, thus reducing friction and the possibility of mechanical seizure.

From the foregoing description of a shut-off damper given by way of example, it will be seen that the invention provides an improved form of sealing means for sealing any gaps which would otherwise exist at the ends of the blades when they are in their fully closed positions.

We claim:

1. A shut-off damper comprising: (a) a frame defining an opening; (b) a line of blades which are supported in and surrounded by said frame for rotary motion about substantially parallel axes to open and close the opening in said frame; (c) at least two thin springy sealing strips made of a relatively hard and strong material arranged at the ends of said blades; and (d) respective coverings of a relatively soft resilient material on said strips, each covering being between the strip it covers and adjacent ends of said blades, whereby the end portions of said blades make sealing contact with said coverings to hinder the leakage of fluid past said blades when they are in their fully closed positions.

2. A damper according to claim 1, in which said springy sealing strips are in the form of stainless steel spring-tempered flexible gaskets.

3. A damper according to claim 1, in which said springy sealing strips are of arched section, their convex sides facing said blades.

4. A damper according to claim 1, in which said resilient material encompasses said springy sealing strips.

5. A damper according to claim 1, in which said resilient material is in extruded form.

6. A damper according to claim 1, in which said resilient material is bonded to said springy sealing strips.

7. A damper according to claim 1, in which the cross-section of said resilient material increases in thickness towards the centre of each strip.

8. A damper according to claim 1, in which said resilient material is in the form of a coating produced by the application of a thermoplastic material in liquid form to each strip, a rubbery coating thus being formed on said strips once the thermoplastic material has set.

9. A damper according to claim 1, in which said blades are of generally streamlined shape, their trailing edges having fluid-sealing means in the form of extrusions of resilient material, the extrusions being nipped between bent-over trailing edge portions of the blades.

10. A damper according to claim 9, in which said blades are stainless steel, low-profile aspect ratio aerofoil blades of spot-welded double-skin construction which interlock a hollow, extruded, rubbery sealing member within twin trailing edges.

11. A damper according to claim 1 having at least one springy sealing strip extending along a side of said frame which is substantially parallel to the rotational axes of said blades so that an edge of an adjacent blade makes sealing contact with the strip when said blades are in their fully-closed positions.

12. A damper according to claim 1 having at least one springy sealing strip extending along a side of said frame which is substantially parallel to the rotational axes of said blades, which strip is provided with a cover of resilient material so that an edge of an adjacent blade makes sealing contact with the resilient material on that strip when said blades are in their fully-closed positions.

13. A damper according to claim 1, in which the said resilient material is a synthetic plastics foam material.

* * * * *